US007219873B2

(12) United States Patent
Harwood

(10) Patent No.: US 7,219,873 B2
(45) Date of Patent: May 22, 2007

(54) SUPPORT BASE FOR A STRUCTURAL POLE

(76) Inventor: Ronald Paul Harwood, 31110 Applewood, Farmington Hills, MI (US) 48331

( * ) Notice: Subject to any disclaimer, the term of this patent is extended or adjusted under 35 U.S.C. 154(b) by 195 days.

(21) Appl. No.: 10/874,822

(22) Filed: Jun. 23, 2004

(65) Prior Publication Data

US 2005/0285011 A1 Dec. 29, 2005

(51) Int. Cl.
*F16M 13/00* (2006.01)

(52) U.S. Cl. ..... 248/519; 181/171; 181/199; 52/296

(58) Field of Classification Search ..... 181/155, 181/153, 154, 145, 146, 151, 199, 171; 52/170, 52/296; 248/519
See application file for complete search history.

(56) References Cited

U.S. PATENT DOCUMENTS

| | | | | |
|---|---|---|---|---|
| 0,121,165 | A | 11/1871 | Gouch | |
| 0,646,970 | A | 4/1900 | Francis | |
| 0,715,362 | A | 12/1902 | Etheridge | |
| 0,837,820 | A | 12/1906 | Folsom et al. | |
| 0,843,762 | A | 2/1907 | Muller | |
| 0,933,291 | A | 9/1909 | Cogswell | |
| 0,985,605 | A | 2/1911 | Konopinski | |
| 0,985,681 | A | 2/1911 | Konopinski | |
| 1,080,525 | A | 12/1913 | Orr | |
| 1,419,108 | A | 6/1922 | Bitting | |
| 1,470,320 | A | 10/1923 | Bolander | |
| 1,497,822 | A | 6/1924 | Williams | |
| 1,593,330 | A | 7/1926 | De La Mare | |
| 1,596,657 | A | 8/1926 | Heber | |
| 1,598,592 | A | 8/1926 | Barrett | |
| 1,600,032 | A | 9/1926 | Barrick et al. | |
| 1,600,066 | A | 9/1926 | Rastetter | |
| RE16,494 | E | 12/1926 | Malone | |
| 1,617,447 | A | 2/1927 | Johnston | |
| 1,696,934 | A | 1/1929 | Allen | |
| 1,732,690 | A | 10/1929 | Marsteller | |
| 1,804,306 | A * | 5/1931 | Bender | 181/188 |
| 1,834,535 | A | 12/1931 | Riemenschneider | |
| 1,882,228 | A | 10/1932 | Page | |
| 1,891,736 | A | 12/1932 | Sporn | |
| 1,906,508 | A | 5/1933 | Arbogast | |

(Continued)

FOREIGN PATENT DOCUMENTS

| | | |
|---|---|---|
| AT | 48598 | 12/2001 |

(Continued)

OTHER PUBLICATIONS http://www.hanoverlantern.com, Hanover Latern, Inc., 18 pages, 2004.

*Primary Examiner*—Amy J. Sterling
(74) *Attorney, Agent, or Firm*—Brooks Kushman P.C.

(57) ABSTRACT

A support base for supporting a structural pole is provided. The support base includes a frame having an internal cavity for housing hardware, such as a speaker assembly, that is associated with the corresponding structural pole. The frame is generally open laterally thereabout for permitting access to the internal cavity. A footing region of the support base secures the frame to an underlying support surface and a platform atop the frame receives the structural pole thereon. The frame is sized to receive an ornamental protective cover thereabout for enhancing the aesthetic perspective of the base and for protecting the hardware within the frame internal cavity.

30 Claims, 6 Drawing Sheets

U.S. PATENT DOCUMENTS

| | | | | | |
|---|---|---|---|---|---|
| 1,939,530 | A | | 12/1933 | Wall | |
| 1,950,677 | A | | 3/1934 | Hogan | |
| 2,090,972 | A | | 8/1937 | Allen | |
| 2,897,553 | A | | 8/1959 | Gorrow | |
| 3,090,461 | A | | 5/1963 | Gray | |
| 3,150,739 | A | | 9/1964 | Dones | |
| 3,170,538 | A | | 2/1965 | Detrick | |
| 3,193,059 | A | | 7/1965 | Wallerstein, Jr. | |
| 3,305,990 | A | | 2/1967 | Hageby | |
| 3,321,160 | A | | 5/1967 | Turnbull | |
| 3,325,950 | A | | 6/1967 | Pfaff, Jr. | |
| 3,326,321 | A | | 6/1967 | Valuch | |
| 3,327,808 | A | | 6/1967 | Shaper | |
| 3,329,235 | A | | 7/1967 | Shaper | |
| 3,347,003 | A | | 10/1967 | Lapp | |
| 3,364,635 | A | | 1/1968 | Guggemos | |
| 3,381,427 | A | | 5/1968 | Watson | |
| 3,400,905 | A | | 9/1968 | Van Dusen, Jr. | |
| 3,486,578 | A | | 12/1969 | Albarino | |
| 3,529,691 | A | * | 9/1970 | Wesemann | 181/156 |
| 3,552,073 | A | * | 1/1971 | Millerbernd | 52/98 |
| 3,606,222 | A | | 9/1971 | Howard | |
| 3,653,169 | A | | 4/1972 | Jenner | |
| 3,671,738 | A | | 6/1972 | Beachley | |
| 3,703,812 | A | | 11/1972 | Newton | |
| 3,750,838 | A | * | 8/1973 | Pyle, Jr. | 181/153 |
| 3,818,138 | A | | 6/1974 | Sperrazza, Jr. | |
| 3,832,679 | A | | 8/1974 | Foley et al. | |
| 3,890,795 | A | | 6/1975 | Maurer | |
| 3,894,375 | A | | 7/1975 | Lindberg, Jr. | |
| 3,942,296 | A | | 3/1976 | Meyer | |
| 3,945,461 | A | | 3/1976 | Robinson | |
| 3,974,372 | A | | 8/1976 | Cochran | |
| 4,063,387 | A | | 12/1977 | Mitchell | |
| 4,079,559 | A | | 3/1978 | Tenbrummeler | |
| 4,095,381 | A | | 6/1978 | Garchinsky | |
| 4,164,988 | A | | 8/1979 | Virva | |
| 4,200,906 | A | | 4/1980 | Santilli | |
| 4,295,308 | A | | 10/1981 | Korfanta | |
| 4,348,549 | A | | 9/1982 | Berlant | |
| 4,451,019 | A | | 5/1984 | Bensel | |
| 4,543,764 | A | | 10/1985 | Kozikowski | |
| 4,574,906 | A | | 3/1986 | White et al. | |
| 4,673,057 | A | | 6/1987 | Glassco | |
| 4,697,959 | A | | 10/1987 | Kinnan | |
| 4,702,057 | A | | 10/1987 | Phillips | |
| 4,754,852 | A | | 7/1988 | Mule et al. | |
| 4,779,389 | A | | 10/1988 | Landers | |
| 4,785,593 | A | | 11/1988 | Munoz, Jr. | |
| 4,878,160 | A | | 10/1989 | Reneau et al. | |
| 4,949,386 | A | | 8/1990 | Hill | |
| 4,953,223 | A | | 8/1990 | Householder | |
| 5,058,169 | A | | 10/1991 | Temmer | |
| 5,060,435 | A | | 10/1991 | Bogdanow | |
| 5,090,837 | A | | 2/1992 | Mower | |
| 5,369,925 | A | | 12/1994 | Vargo | |
| 5,444,194 | A | | 8/1995 | Reinke | |
| 5,454,202 | A | | 10/1995 | van der Weijden | |
| 5,504,397 | A | * | 4/1996 | Chien | 315/185 S |
| 5,524,408 | A | | 6/1996 | Richey | |
| 5,525,767 | A | * | 6/1996 | Fields | 181/155 |
| 5,571,229 | A | | 11/1996 | Fitzsimmons et al. | |
| 5,634,482 | A | | 6/1997 | Martin | |
| 5,704,580 | A | | 1/1998 | Peery, Jr. | |
| 5,720,134 | A | | 2/1998 | Kurtz | |
| 5,721,401 | A | * | 2/1998 | Sim | 181/148 |
| 5,752,349 | A | | 5/1998 | Fitzsimmons et al. | |
| 5,758,856 | A | | 6/1998 | Carnahan et al. | |
| 5,802,190 | A | | 9/1998 | Ferren | |
| 5,802,193 | A | * | 9/1998 | Kieltyka | 381/386 |
| 5,828,765 | A | | 10/1998 | Gable | |
| 5,832,099 | A | | 11/1998 | Wiener | |
| 5,832,675 | A | | 11/1998 | Zuares | |
| 5,946,401 | A | | 8/1999 | Ferren | |
| 5,988,314 | A | | 11/1999 | Negishi | |
| 5,995,634 | A | | 11/1999 | Zwolski | |
| 6,021,208 | A | | 2/2000 | Kin-Lung | |
| 6,056,083 | A | | 5/2000 | Daniell | |
| 6,061,939 | A | | 5/2000 | Gildea | |
| 6,240,689 | B1 | | 6/2001 | Haddad et al. | |
| 6,256,961 | B1 | | 7/2001 | Byrnes | |
| 6,327,833 | B1 | | 12/2001 | Miskelley et al. | |
| 6,335,975 | B1 | | 1/2002 | Yang | |
| 6,340,936 | B1 | * | 1/2002 | McGaffey et al. | 340/944 |
| 6,345,685 | B1 | | 2/2002 | Wells et al. | |
| 6,402,337 | B1 | | 6/2002 | LeVasseur et al. | |
| 6,411,721 | B1 | | 6/2002 | Spindler | |
| 6,684,580 | B1 | | 2/2004 | Hull | |
| 6,742,314 | B2 | | 6/2004 | Young | |
| 6,909,374 | B2 | * | 6/2005 | Fong | 340/689 |

FOREIGN PATENT DOCUMENTS

| | | |
|---|---|---|
| CH | 46375 | 3/1910 |
| DE | 24 50 064 A1 | 4/1975 |
| DE | 37 21 115 A1 | 1/1988 |
| FR | 574337 | 7/1924 |
| FR | 2 654 762 A1 | 5/1991 |
| FR | 2 690 730 A1 | 11/1993 |
| GB | 310648 | 5/1929 |

* cited by examiner

SUPPORT BASE FOR A STRUCTURAL POLE

BACKGROUND OF THE INVENTION

1. Field of the Invention

The invention relates to a structural pole, more particularly to a base of a structural pole.

2. Background Art

Structural poles have been utilized for public thoroughfares, sidewalks, landscapes and large interior spaces. These areas include city streets, parks, residential neighborhoods, office buildings, campus areas, exterior walkways, shopping malls, atriums, casinos, and the like. These structural poles include light poles, traffic poles, utility poles, bollards, speaker poles and the like. The poles are fixed to an underlying support surface through various arrangements. For example, the poles may include a direct burial post, a base that is unitary with the pole and can be fastened to the underlying support surface, or a separate base that is fastened to the underlying support surface and receives the pole. For decorative purposes, these bases have been cosmetically enhanced with ornamental indicia cast or formed thereon or, alternatively provided in a cover or apron that may be affixed over the fixed end of the structural pole.

Each of these structural pole base examples includes a removable access door or the like for providing access to an internal cavity of the pole so that cables, or wires for power or signals to equipment supported by the pole can be accessed. These access doors provide limited access to the components housed therein and limit the availability of components that can be inserted through the access door.

In many thoroughfares it is desirable to provide more than just lighting on a structural pole. For example, electronic sign displays may be mounted to the pole or speaker systems or the like. It is also desirable to provide such auxiliary features to the structural pole while preventing the features from being accessible to the elements or vandalism. It is also desirable to conceal such auxiliary equipment to avoid obfuscating the aesthetic appeal within the given location. Accordingly, the prior art has partially addressed this need by mounting speaker assemblies within a fixed end of a structural pole and spacing the fixed end of the structural pole above the underlying support surface so that acoustical vibrations provided by the speaker assembly exit the structural pole omnidirectionally.

A goal of the present invention is to provide a support base for a structural pole that enhances flexibility in hardware mounting without upsetting the aesthetic or ornamental aspects thereof.

SUMMARY OF THE INVENTION

An aspect of the present invention is to provide a support base for supporting a structural pole upon and spaced above an underlying support surface. The base includes a footing region that is adapted to secure the support base to the underlying support surface. A frame extends upward from the footing region and defines an internal cavity for housing hardware that is associated with the pole. The frame is generally open laterally thereabout for permitting access to the internal cavity. A platform is secured atop the frame for mounting the structural pole thereto. The frame is sized to receive an ornamental and protective cover thereabout for enhancing the aesthetic perspective of the base and for protecting the hardware within the frame internal cavity.

A further aspect of the present invention is to provide a plate within the frame internal cavity for receiving and supporting the hardware.

Another aspect of the invention is to provide a speaker assembly within the frame internal cavity of the support base. The speaker assembly includes a mid-plate supported by the frame, a speaker mounted to the mid-plate, and a resonating chamber. The speaker is oriented so that acoustical vibrations provided by the speaker are directed toward one of the underlying support surface of the support base and the base platform.

The above aspects, and other aspects, objects, features, and advantages of the present invention are readily apparent from the following detailed description of the preferred embodiments when taken in connection with the accompanying drawings.

DETAILED DESCRIPTION OF THE PREFERRED EMBODIMENTS

Figure 1:
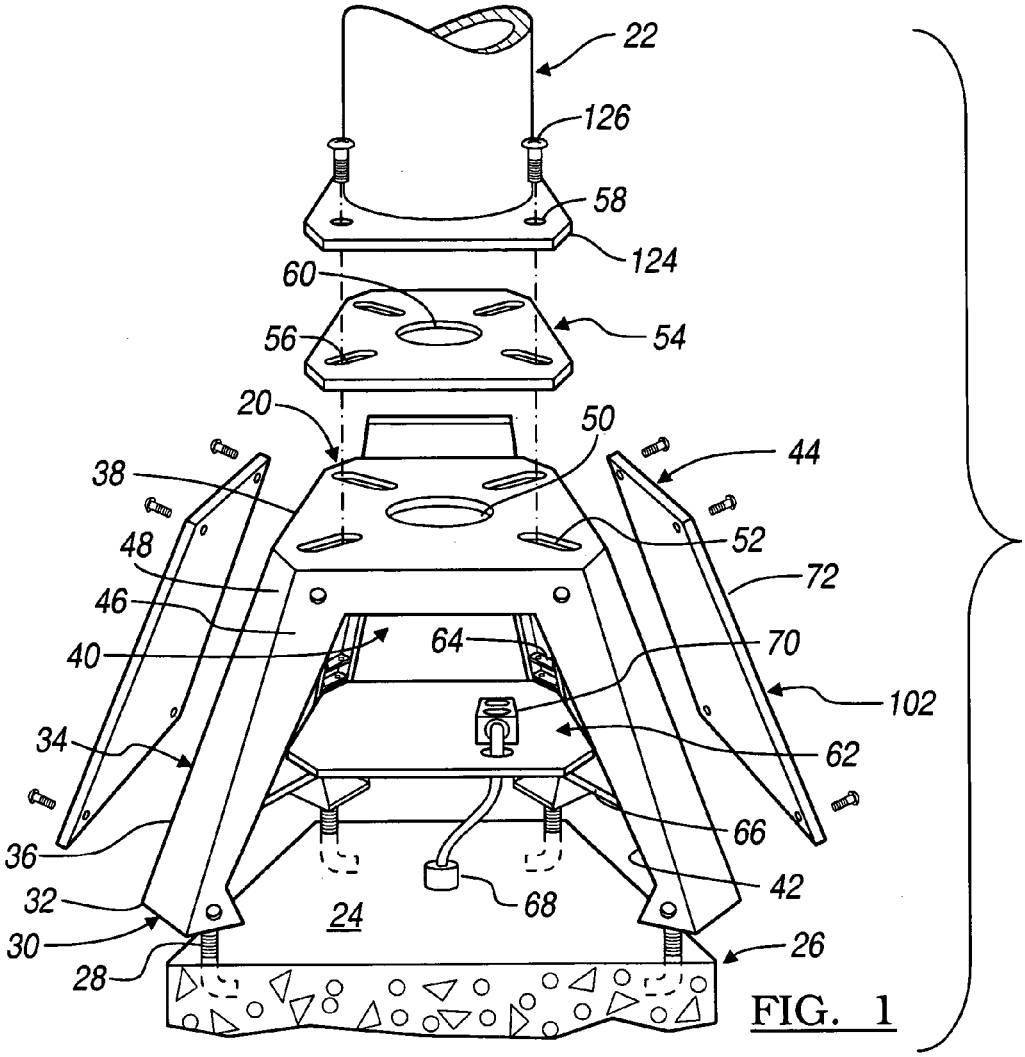
FIG. 1 is an exploded, side perspective view of a support base in accordance with the teachings of the present invention, illustrated in cooperation with a structural pole.

Referring to FIG. 1, a support base is illustrated exploded and is referenced generally by numeral 20. The support base 20 is provided for supporting a structural pole 22 upon and spaced above an underlying support surface 24. The support base 20 can be provided with the structural pole 22 or can be utilized to retrofit the structural pole 22 thereby raising the structural pole 22 and providing a housing for containing hardware thereunder.

The underlying support surface 24 illustrated in FIG. 1 is provided by a pier base 26. Structural poles are commonly mounted upon pier bases, which are commonly formed of concrete and poured as a footing for the associated structural pole. Pier bases 26 commonly include a plurality of J-bolts 28 that are provided in the pier base 26 when the pier base 26 is formed for mounting the structural pole 22 thereto.

The support base 20 has a lower footing region 30 provided by a series of feet 32 that rest upon the underlying support surface 24. The feet 32 collectively include a hole pattern for mating with the corresponding J-bolts 28 so that the support base 20 is fastened to the J-bolts 28.

The support base 20 includes a frame 34 extending from the footing region 30. The frame 34 is defined by a series of legs 36 that each include one of the feet 32. The legs 36 each terminate at a platform 38. The structural pole 22 is fastened to the platform 38 and the frame 34 supports the structural pole 22 upon the underlying support surface 24.

The frame 34 is formed of aluminum, steel or the like, to satisfy the specific structural requirements dictated by the load provided by the structural pole 22. The support base 20 can be formed as a weldment or as a casting. The footing region 30 can be sized for an enlarged J-bolt 28 pattern as illustrated, or can include a hole pattern corresponding with a narrower J-bolt pattern that is sized to receive the structural pole 22 directly thereto. For example, the legs 36 can be aligned generally vertically rather than tapered as illustrated in FIG. 1. Alternatively, a flange may extend inwards from each foot 32 for fastening the foot 32 to the corresponding J-bolt 28.

The frame 34 defines an internal cavity 40 for housing hardware that is associated with the structural pole 22. The frame internal cavity 40 includes more volume than that of a typical prior art pole base. Additionally, due to the structure of the frame 34, the frame internal cavity 40 includes a large area to mount the associated hardware. Structural pole assemblies and the structural pole internal cavities are an inconspicuous location to mount the associated hardware. By mounting hardware associated with the structural pole 22 within the frame internal cavity 40, the hardware is protected from the elements and is protected from vandalism and theft. Additionally, since the hardware is out of sight, it is less likely to be subjected to vandalism and theft.

The frame 34 of the support base 20 provides a structure that includes a series of lateral openings 42 between sequential legs 36. The openings 42 cause the frame 34 to be generally open about its periphery. Specifically, the openings 42 are provided at each lateral side thereof. Therefore, a user or operator has a wide range of access into the frame internal cavity 40. Unlike prior art bases that provide limited windows of access through access doors formed within the base, the support base 20 of the present invention is generally open laterally about the frame 34 providing generally 360 degrees of access into the frame internal cavity 40. This wider range of access is possible because unlike the prior art, the support base 20 is provided independently of the ornamental features. Therefore, the access is not limited to access doors formed within ornamental features of the base, rather the support base 20 is provided separately from a corresponding cover 44.

The support base 20 of the present invention is illustrated as a frustum of a pyramid. The pyramid includes four primary surfaces 46 and four beveled surfaces 48. Each beveled surface 48 is provided between a sequential pair of primary surfaces 46. Although an eight sided pyramid is illustrated, any structural arrangement is contemplated including any polyhedron, regardless of the number of surfaces and regardless if the surfaces are tapered or not.

The platform 38 includes at least one aperture 50 formed therethrough for the passage of wires or cables to equipment provided upon the structural pole 22. Additionally, the platform 38 includes a plurality of slots 52 for providing a mounting pattern for fastening the structural pole 22 thereto. Each slot 52 extends outwardly in a radial direction so that various structural poles 22 ranging in size can be fastened to the platform 38. If the hole pattern from a structural pole does not mate with the slots 52 provided in the platform 38, an adapter plate 54 can be provided having a hole pattern 56 that matches a hole pattern 58 of the corresponding structural pole 22 and the slots 52 of the platform 38. The adapter plate 54 also includes at least one aperture 60 formed therethrough so that cables, wires or the like can be passed therethrough.

The support base 20 includes a plate 62 within the frame internal cavity 40. The plate 62 is supported by the frame 34 for receiving and supporting hardware at an orientation spaced above the underlying support surface 24. The plate 62 raises the associated hardware so that if inclement weather, such as rain or snow were to pass underneath the frame 34 into the frame internal cavity 40, the hardware would be elevated to avoid damage caused by the elements. Additionally, the plate 62 raises the hardware to assist in organization of the hardware within the support base 20 and for ergonomic accessibility. The plate 62 is adjustable in height for enhancing the flexibility provided by the plate 62. Accordingly, mounting brackets 64 are provided within each leg 36, and support brackets 66 are fastened to the plate 62 and to each corresponding mounting bracket 64.

Many structural poles 22 such as light poles, traffic poles and the like require a source of power. Accordingly, conduit 68 is typically provided within the pier base 26 for conveying power cables, wires or the like to the structural pole 22. Accordingly, an electrical junction box 70 is provided on the plate 62 for receiving power, signals or the like, provided from the conduit 68 so that equipment associated with the structural pole 22 is readily connected to the junction box 70.

As discussed above, the support base 20 is formed independently of the associated ornamental effects, and various ornamental covers may be provided. Thus, the support base 20 does not limit the ornamental effects of the support base and the ornamental effects are interchangeable without having to replace the support base 20. As illustrated in FIG. 1, the cover 44 is provided by a plurality of panels 72, each fastened to one of the primary surfaces 46 of the support base 20. Each panel 72 includes ornamental indicia formed on the external side thereof. The cover enhances the aesthetic perspective of the support base 20 and protects the hardware within the frame internal cavity 40 from the elements, vandalism and theft. Ornamental panels may also be provided upon the beveled surfaces 48, although not shown. Of course, the panel 72 can be attached by any fastener, yet a tamper resistant fastener, such as a screw with an unconventional head is desired. Alternatively, a lock may be provided between each panel 72 and the frame 36.

Figure 2:
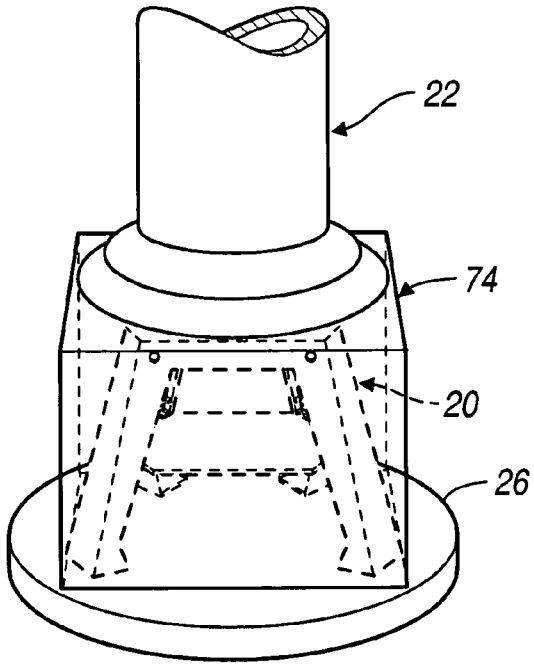
FIG. 2 is a side perspective view of the support base of FIG. 1, illustrated with an alternative embodiment cover affixed thereto.
Figure 3:
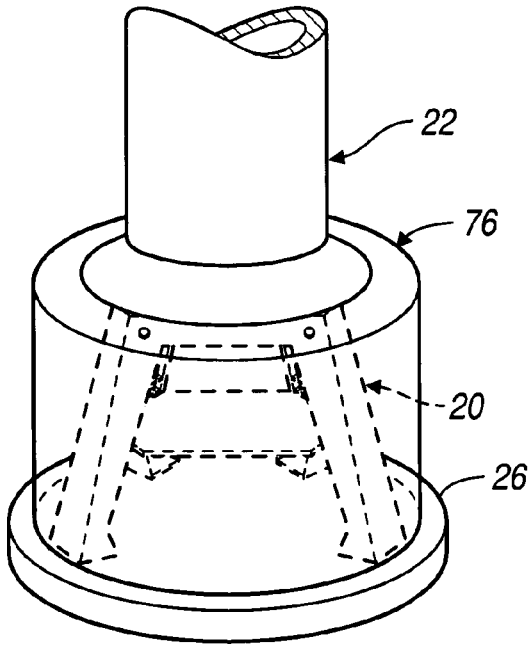
FIG. 3 is a side perspective view of the support base of FIG. 1, illustrated with another alternative embodiment cover affixed thereto.

Referring now to FIGS. 2 to 3, the support base 20 is illustrated with alternative embodiment covers. Specifically, the support base 20 in FIG. 2 is illustrated cooperating with a two-piece cover 74. The cover 74 is provided in a clam shell configuration wherein two separate generally symmetrical pieces are fastened together to cover the support base 20. The ornamental structure of the cover 74 is independent of the geometrical arrangement of the support base 20. Therefore, various aesthetic perspectives are contemplated and are interchangeable with the support base 20 of the present invention. The cover 74 is generally tubular with a rectangular cross-section.

In FIG. 3, another two-piece clam shell cover 76 is illustrated in accordance with the present invention. The cover 76 is similar to the cover 74 in FIG. 2, however the cover 76 in FIG. 3 is generally cylindrical. Of course, ornamental indicia can be provided on the exterior of the cover 74 and 76 in FIGS. 2 and 3.

Figure 4:
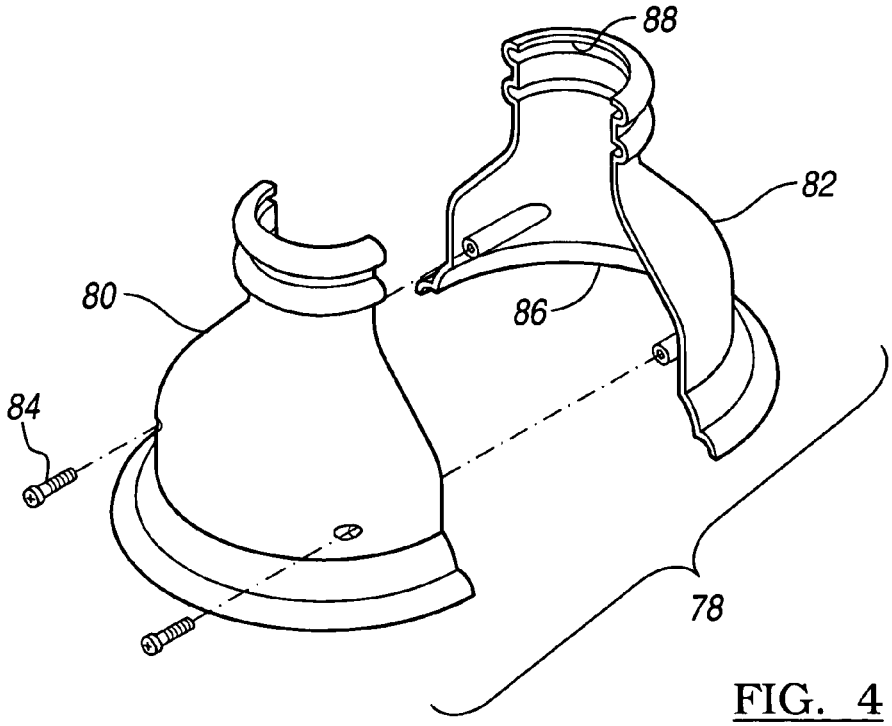
FIG. 4 is an exploded, side perspective view of yet another alternative embodiment cover in accordance with the teachings of the present invention.

Referring now to FIG. 4, another two-piece cover 78 is illustrated. The cover 78 includes two clam shell portions 80, 82 that are adapted to wrap about the support base 20 and enclose the support base 20 therein. The clam shell portions 80, 82 are fastened together by a pair of screws 84 or the like. The clam shell portions 80, 82 collectively provide a lower open region 86 for permitting the support base 20 to engage the underlying support surface 24. The clam shell portions 80, 82 also collectively provide an upper open region 88 for permitting the structural pole 22 to pass therethrough.

Figure 5:
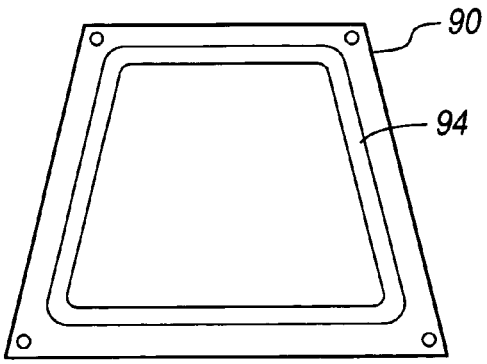
FIG. 5 is a front side elevation view of an alternative embodiment cover in accordance with the teachings of the present invention.
Figure 6:
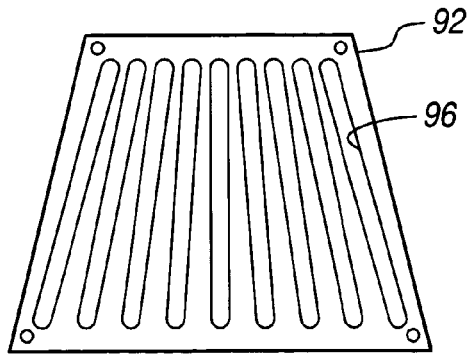
FIG. 6 is a front side elevation view of another alternative embodiment cover in accordance with the teachings of the present invention.

Referring now to FIGS. 5 and 6, alternative panels 90, 92 are illustrated respectively, which can be fastened directly to the support base 20. The panel 90 of FIG. 5 includes an ornamental raised panel 94 thereon. The panel 92 of FIG. 6 includes fluting 96 formed therein.

The covers illustrated in FIGS. 1 through 6 are by means of example only, as any ornamental cover is contemplated within the spirit and scope of the present invention. The covers can be attached by various methods and can be made of various materials. The covers can be decorative in shape or can have ornamental indicia formed thereon. The covers can include light sources affixed thereto for low leveling lighting, flag lighting or emergency illumination. Alternatively, the covers can be vented or be generally transparent to allow illumination from within the frame internal cavity 40 to emit through the corresponding cover.

Figure 7:
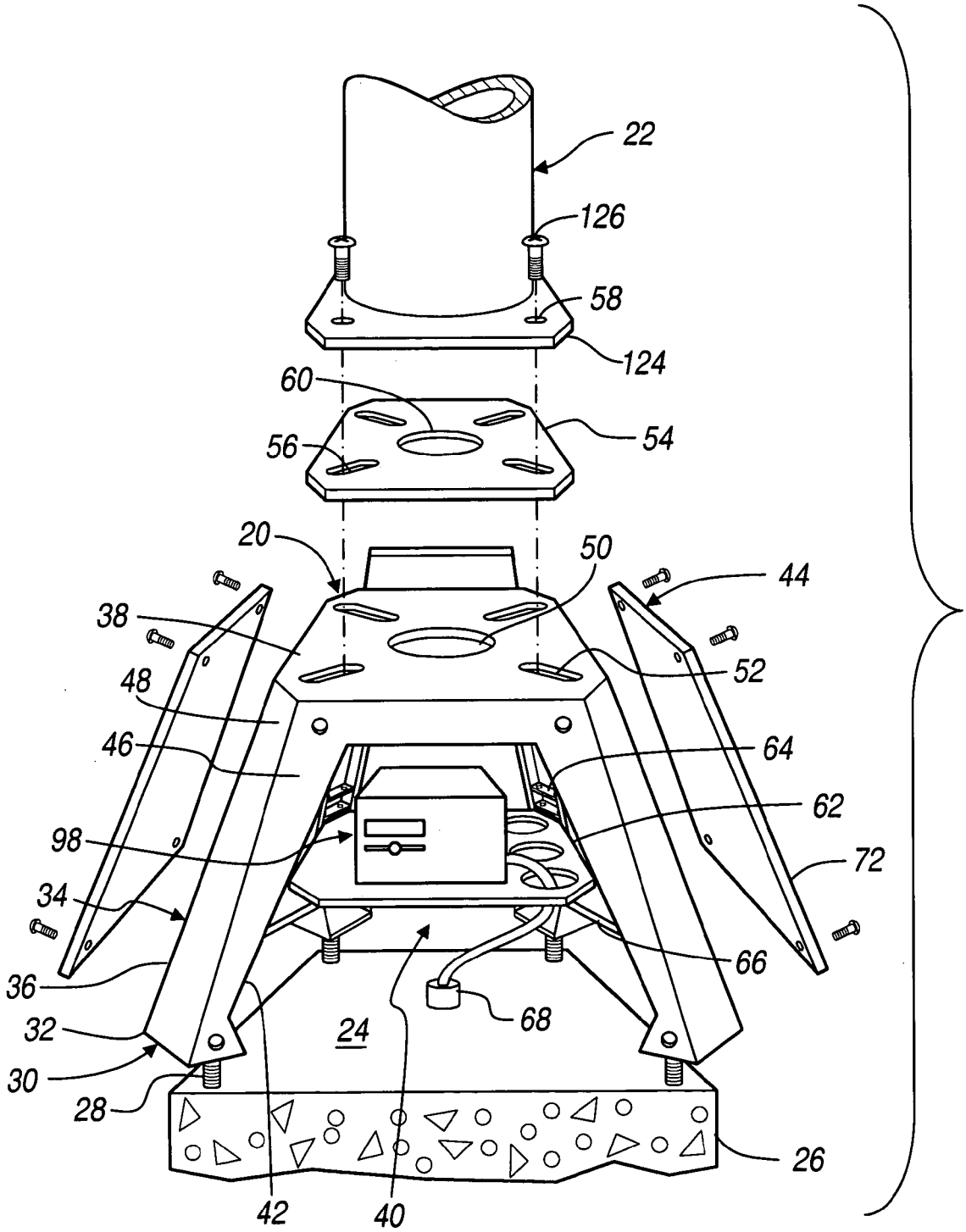
FIG. 7 is an exploded, side perspective view of the support base in FIG. 1, illustrated with hardware mounted therein.

Referring now to FIG. 7, the support base 20 is illustrated with a central processing unit (CPU) 98 mounted to the plate 62. The CPU 98 is provided to control lighting or traffic signals provided upon the structural pole 22. Additionally, storage batteries can be contained within the unit. For example, photo-voltaic cells can be provided upon the structural pole 22 for recharging a battery within the support base 20. The CPU 98 may perform wireless communication for receiving and/or transmitting signals. For example, the CPU 98 may receive wireless signals associated with the controls thereof. The structural pole 22 may include an illuminated sign and the CPU 98 may provide a digital signage processor for controlling the image upon the sign. If the structural pole 22 includes a speaker assembly, mounted externally of the structural pole 22 or internally of the structural pole 22 or support base 20, the CPU 98 may provide signal boosting to the associated speaker assembly. If the structural pole 22 includes a digital identification card reader, the CPU 98 may provide the processing for this card reader. The aforementioned examples are provided to illustrate the hardware flexibility provided by the support base 20 and are not an exhaustive list of options that may be incorporated within the support base 20.

Figure 8:
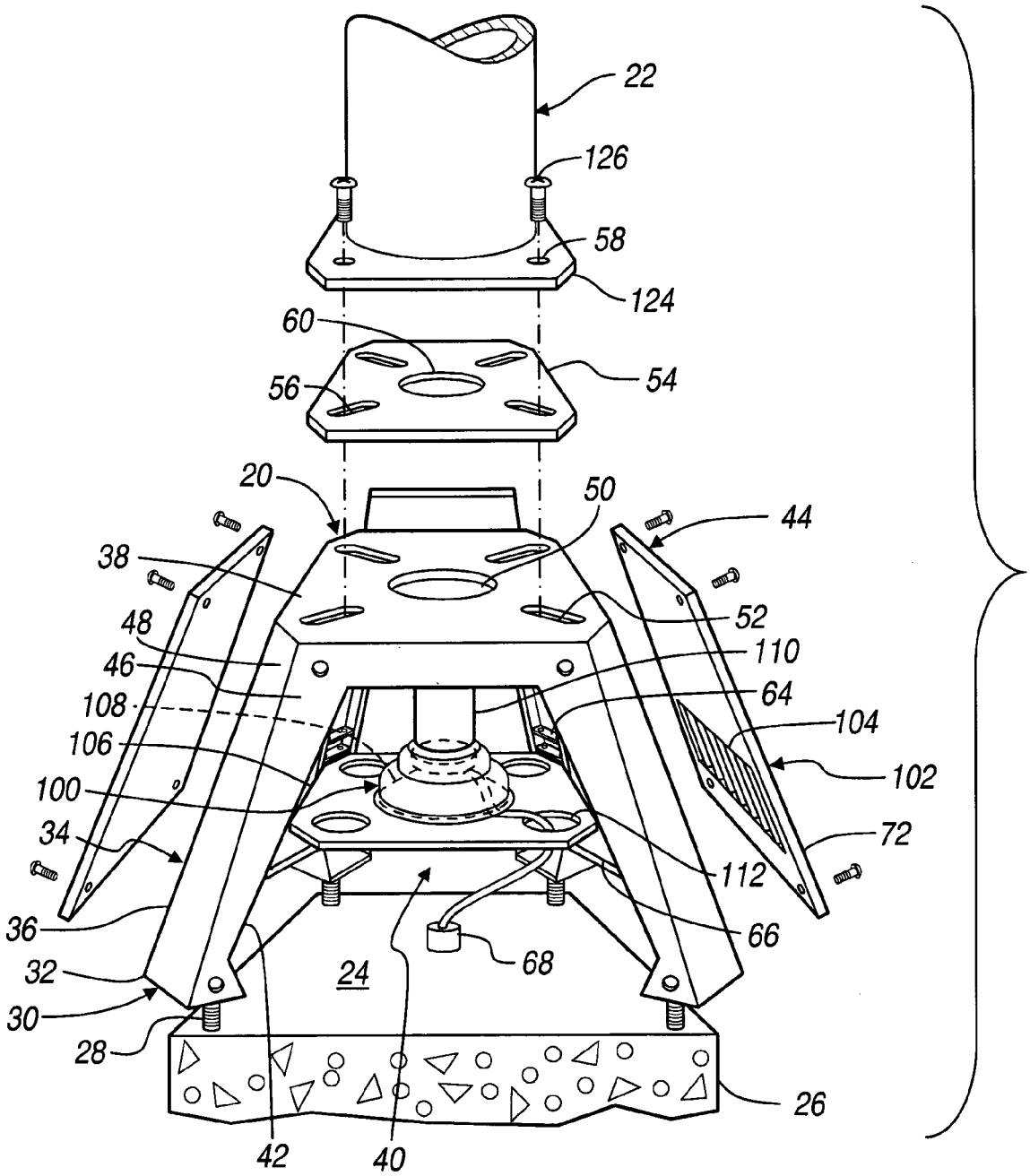
FIG. 8 is an exploded, side perspective view of the support base in FIG. 1, illustrated with alternative hardware mounted therein.

With reference now to FIG. 8, the support base 20 is illustrated having a speaker assembly 100 mounted within the frame internal cavity 40. The speaker assembly 100 is directed downward to the underlying support surface 24 so that acoustical vibrations provided by the speaker assembly 100 are reflected from the underlying support surface 24 and out of the frame 34. The lateral openings 42 in the frame 36 provide an acoustical outlet region such that the acoustical vibrations pass from the frame 34. A cover 102 is provided having an acoustically transparent region 104 so that acoustical vibrations provided by the speaker assembly 100 pass through the cover 102.

The speaker assembly 100 adopts the teachings of Applicant's copending U.S. patent application Ser. No. 10/324,563, titled Pole Speaker, which was filed on Dec. 19, 2002. The Pole Speaker patent application is incorporated by reference in its entirety herein. The speaker assembly 100 includes a mid-plate 106 mounted to the frame 34 within the frame internal cavity 40. A cone speaker 108 is mounted to the mid-plate 106 directed towards the underlying support surface 24. A resonating chamber member 110 is provided having a wall defining an elongated internal cavity oriented within the frame internal cavity 40. The resonating chamber member 110 has an open end mounted adjacent to the speaker 108. The resonating chamber member internal cavity is sized to match the speaker 108.

It may be desirable to prevent acoustical vibrations provided by the speaker assembly 100 from resonating within an internal cavity of the structural pole 22. Therefore, each aperture 112 can be filled with a rubber grommet, foam or the like after wires are passed therethrough. Additionally, gaps provided between the mid-plate 106 and the frame 34 can be plugged by foam or some other acoustically inert material.

The speaker assembly 100 can be tuned by spacing the speaker assembly 100 relative to the pier base 26 such that the acoustical vibrations provided by the speaker 108 are reflected in a manner so that the sound reproduction lies in a region proximate to a head elevation of people passing thereby. Accordingly, spacing between the mid-plate 106 and the pier base 26 is a function of the distance between the support base 20 and a populated area proximate thereto. A preferred spacing of the speaker assembly 100 is adjusted by the brackets 64, 66. Due to the acoustically transparent region 104 provided in the cover 102, sound reproduction exits the support base 20 generally omnidirectionally, in a general 360 degree range about the support base 20. The invention contemplates various speakers and speaker arrangements for directing acoustical vibrations omnidirectionally, uni-directionally or in focused patterns or regions.

Figure 9:
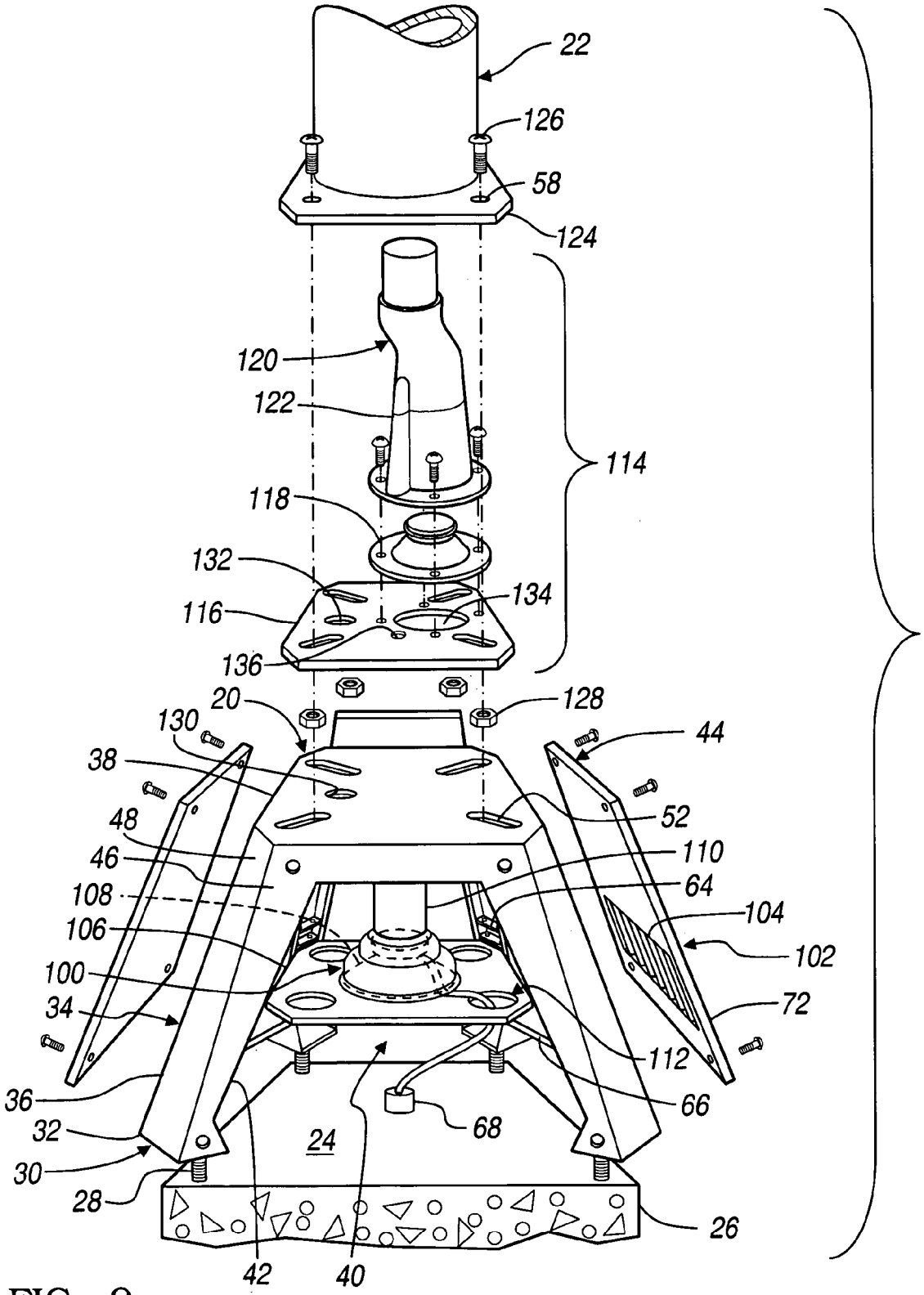
FIG. 9 is an exploded, side perspective view of the support base of FIG. 1, illustrated with hardware mounted within the support base and within the corresponding structural pole.

Referring now to FIG. 9, the support base 20 is illustrated with the first speaker assembly 100 mounted therein as discussed with reference to FIG. 9. Further, a second speaker assembly 114 is provided within the structural pole 22. The second speaker assembly 114 also incorporates the teachings of the Pole Speaker application, which was incorporated by reference above. The second speaker assembly 114 includes a sub-plate 116, a speaker 118, a resonating chamber member 120 and a tubular port 122. The sub-plate 116 is adapted to be affixed to the structural pole 22 adjacent to an internal cavity formed in a fixed end of the structural pole 22. Specifically, the sub-plate 116 is illustrated having a foot print and hole pattern to match that of a mounting flange 124 of the structural pole 22. The speaker 118 is mounted to the sub-plate 116 and oriented such that acoustical vibrations provided by the speaker 118 are directed toward a top surface of the platform 38 of the support base 20.

The resonating chamber member 120 has a wall for defining an elongated internal cavity oriented within the structural pole internal cavity. The resonating chamber member 120 has an open end mounted adjacent to the speaker 118 for partially enclosing a back surface of the speaker 118. Preferably, the speaker 118 and resonating chamber member 120 are sealed to provide an airtight resonating chamber internal cavity. The resonating chamber member internal cavity is sized specifically for the speaker 118. The resonating chamber member internal cavity reflects backward acoustical vibrations provided by the speaker 118 and amplifies the overall sound reproduction created thereby.

The tubular port 122 is connected to the resonating chamber member 120 and is in communication with the resonating chamber member internal cavity. The port 122 is sized to provide fluid resistance to air entering and exiting the resonating chamber member internal cavity in response to acoustical vibrations provided by the speaker 118 for improving the sound quality. Although the tubular port 122 improves the sound quality of the speaker system 100, the port 122 is optional. Without the tubular port 122, the resonating chamber member internal cavity prevents a vibrational overdraft to the speaker 118, similar to a properly sized tubular port 122. Elimination of the tubular port 122, also reduces manufacturing costs incurred by the inclusion of the port 122. The first speaker assembly 100 can include a tubular port as well.

The sub-plate 116 is fastened to the mounting flange 124 of the structural pole 22. The sub-plate 116 has a hole pattern consistent with that of the mounting flange 124 such that it may utilize the same hardware, such as screws 126 for fastening the sub-plate 116 to the mounting flange 124. The cooperating screws 126, mounting flange 124, sub-plate 116 and platform slots 52 are also employed for spacing the bottom of the speaker assembly 114 away from a top surface of the platform 38. A plurality of adjustment nuts 128 are each mounted to one of the screws 126 such that the sub-plate 116 can rest thereupon, for spacing the second speaker assembly 114 from the platform 38. This spacing is adjusted to a user selected height for tuning the speaker assembly 114 as discussed with tuning the first speaker assembly 100.

The sub-plate 116 is provided from an acoustically inert material so that it acts as a baffle for preventing acoustic vibrations from reflecting from the platform 38 and resonating within the structural pole 22. The platform 38 includes an offset aperture 130 and the sub-plate 116 includes a corresponding offset aperture 132 so that a wire harness can pass from the support base 20 into the structural pole 22 for providing wiring to the second speaker assembly 114 and to equipment associated with the structural pole 22. Apertures 130 and 132 can be plugged by a grommet or sealant for providing a sound tight connection therebetween. The sub-plate 116 includes a speaker aperture 134 for permitting acoustical vibrations to pass from the speaker 118 through the sub-plate 116. The sub-plate 116 includes a mounting hole pattern oriented thereabout for fastening the speaker 118 and/or the resonating chamber member 120 thereto. Adjacent to the speaker aperture 134 is a port aperture 136 in communication with the tubular port 122 for venting the resonating chamber internal cavity.

The combination of two separated speaker assemblies 100, 114 provided within a common structural pole assembly permits the utilization of speakers varying in frequency. For example, the first speaker assembly 100 provides frequencies below human voice and therefore provides a low frequency acoustical output, such as a sub-woofer. The second speaker assembly 114 provides a high frequency acoustical output including human voice and above.

Figure 10:
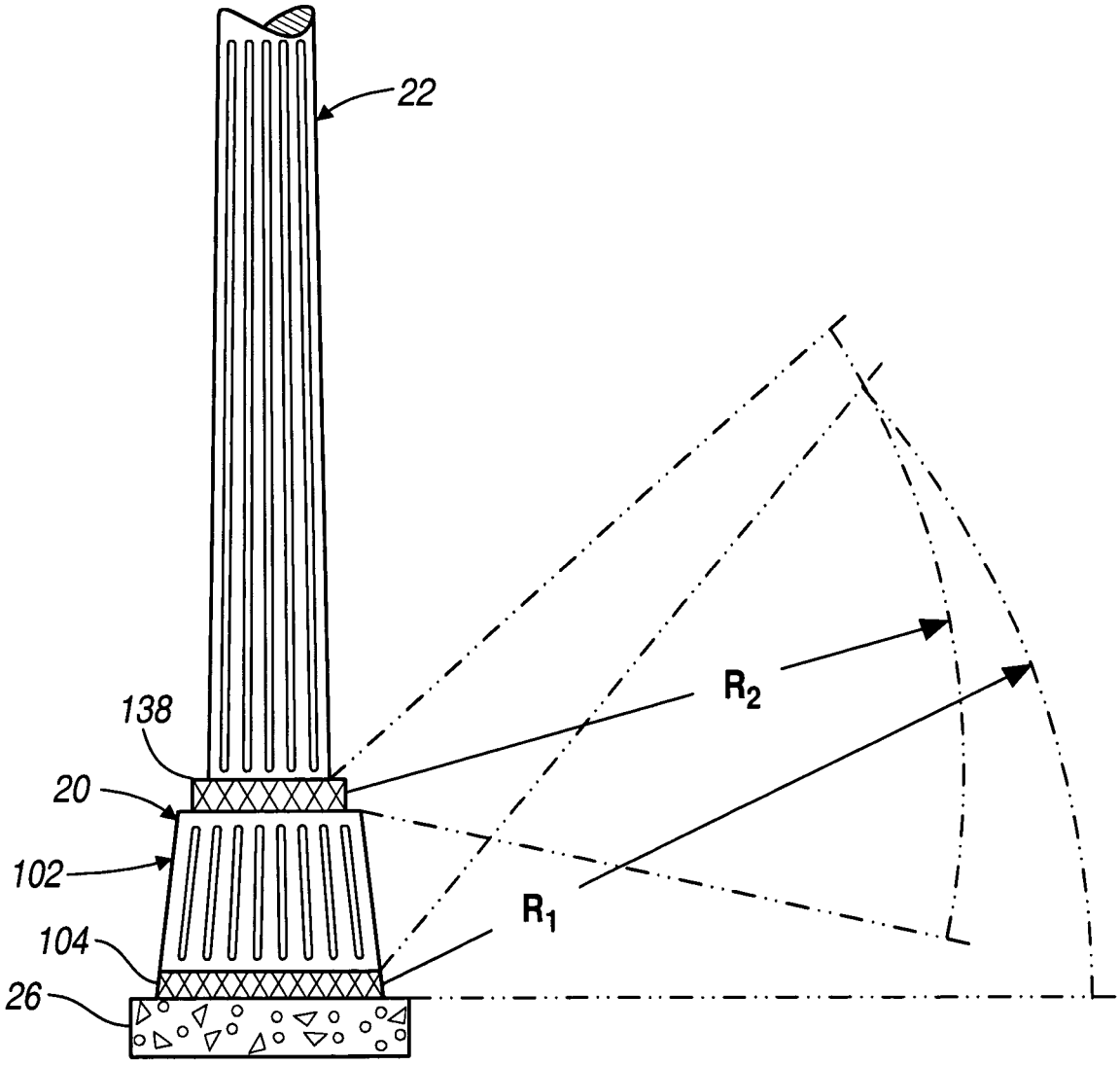
FIG. 10 is a side elevation view of the support base and structural pole of FIG. 9, illustrating ranges of acoustical vibrations emitted therefrom.

With reference now to FIG. 10, the assembled structural pole assembly of FIG. 9 is illustrated. An acoustically transparent skirt 138 has been added atop the structural pole mounting flange 124 and extending to the platform 38 to cover the screws 126 and the gap provided between the sub-plate 116 and the platform 38 while permitting acoustical vibrations to emit therefrom. A range of acoustical vibrations provided by the first speaker assembly 100 is illustrated partially by $R_1$. A range of acoustical vibrations provided by the second speaker assembly 114 is illustrated partially by $R_2$. These ranges of acoustical vibrations can be tuned as discussed above so that the ranges overlap within a target region that will be received by passersby. Accordingly, passersby of the specific thoroughfare will receive a combination of acoustical vibrations encompassing frequencies provided by at least a pair of speaker assemblies resulting in a high quality sound reproduction.

In summary, the present invention provides a low cost, simplifed support base 20 for a structural pole 22 providing flexibility for a range of functional equipment to be incorporated therein.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A support base for supporting a structural pole upon and spaced above an underlying support surface, the support base comprising:

a footing region adapted to secure the support base to the underlying support surface;

a frame extending from the footing region, for supporting the structural pole upon the underlying support surface, the frame defining an internal cavity for housing hardware that is associated with the corresponding structural pole, the frame having at least two access openings formed through lateral sides of the frame for permitting access to the internal cavity;

a platform secured atop the frame, spaced apart from and opposing the footing region, the platform being adapted to secure the structural pole thereupon;

at least one plate oriented within the frame internal cavity and supported by the frame for receiving and supporting the hardware that is housed within the frame internal cavity at an orientation spaced above the underlying support surface;

wherein the frame is sized to receive an ornamental and protective cover thereabout for enhancing the aesthetic perspective of the base and for protecting the hardware within the frame internal cavity; and a speaker assembly including:

a mid-plate oriented within the frame internal cavity and supported by the frame, the mid-plate being spaced apart from the at least one plate, a speaker mounted to the mid-plate and oriented such that acoustical vibrations provided by the speaker are directed toward one of the underlying support surface and the base platform, and a resonating chamber member having a wall defining an elongated internal cavity oriented within the frame internal cavity, the resonating chamber member having an open end mounted adjacent to the speaker, and the resonating chamber member internal cavity being sized to match the speaker;

wherein the base has an acoustical outlet region for permitting acoustical vibrations to pass therethrough; and wherein the mid-plate is adjustable in height relative to the underlying support surface.

2. The support base of claim 1 wherein the support base is a weldment.

3. The support base of claim 1 wherein the underlying support surface is further defined as a pier base, and the footing region includes a hole pattern for mounting the base to a plurality of J-bolts extending from the pier base.

4. The support base of claim 1 wherein the frame further comprises a series of legs extending from the footing region to the platform.

5. The support base of claim 1 wherein the frame is a polyhedron.

6. The support base of claim 1 wherein the frame is a frustum of a pyramid.

7. The support base of claim 1 further comprising a two piece cover that is sized to be secured about the frame, the cover including an aperture for permitting the structural pole to extend therethrough.

8. The support base of claim 1 further comprising a cover defined by a series of ornamental panels, each adapted to be fastened to the frame.

9. The support base of claim 1 further comprising an electrical junction for connecting the structural pole to a power source.

10. The support base of claim 1 further comprising bracketry mounted therein for supporting the at least one plate.

11. The support base of claim 1 wherein the at least one plate is adjustable in height relative to the underlying support surface.

12. A structural light pole assembly comprising:

a support base including:

a footing region adapted to secure the support base to an underlying support surface, a frame extending from the footing region, the frame defining an internal cavity for housing hardware that is associated with the structural light pole assembly, the frame being generally open laterally thereabout for permitting access to the internal cavity, and a platform secured atop the frame, spaced apart from and opposing the footing region;

a structural light pole having a fixed end mounted to the base platform such that the structural light pole is spaced apart from the underlying support surface and supported by the base and the underlying support surface;

wherein the support base is sized to receive an ornamental and protective cover thereabout for enhancing the aesthetic perspective of the base and for protecting the hardware within the frame internal cavity; and a speaker assembly including:

a mid-plate oriented within the frame internal cavity and supported by the frame, a speaker mounted to the mid-plate and oriented such that acoustical vibrations provided by the sneaker are directed toward one of the underlying support surface and the base platform, and a resonating chamber member having a wall defining an elongated internal cavity oriented within the frame internal cavity, the resonating chamber member having an open end mounted adjacent to the sneaker; and the resonating chamber member internal cavity being sized to match the speaker;

wherein the base has an acoustical outlet region for permitting acoustical vibrations to pass therethrough; and wherein the mid-plate is adjustable in height relative to the underlying support surface.

13. A structural pole assembly comprising:

a support base including:

a footing region adapted to secure the support base to an underlying support surface, a frame extending from the footing region, the frame defining an internal cavity for housing hardware that is associated with the structural pole assembly, the frame being generally open laterally thereabout for permitting access to the internal cavity, and a platform secured atop the frame, spaced apart from and opposing the footing region;

a structural pole having a fixed end mounted to the base platform such that the structural pole is spaced apart from the underlying support surface and supported by the base and the underlying support surface; and a speaker assembly including:

a sub-plate adapted to be affixed to the structural pole adjacent to an internal cavity formed in the fixed end of the structural pole, the sub-plate being spaced apart from the platform, a speaker mounted to the sub-plate and oriented such that acoustical vibrations provided by the speaker are directed toward the base platform, and a resonating chamber member having a wall defining an elongated internal cavity oriented within the structural pole internal cavity, the resonating chamber member having an open end mounted adjacent to the speaker, and the resonating chamber member internal cavity being sized to match the speaker;

wherein the support base is sized to receive an ornamental and protective cover thereabout for enhancing the aesthetic perspective of the base and for protecting the hardware within the frame internal cavity;

wherein the structural pole fixed end has an acoustical outlet region for permitting acoustical vibrations to pass therethrough; and wherein the sub-plate is adjustable in height relative to the underlying support surface.

14. The structural light pole assembly of claim 12 further comprising an electrical junction oriented within the frame internal cavity for connecting the structural light pole to a power source.

15. The structural light pole assembly of claim 12 further comprising a central processing unit oriented within the frame internal cavity.

16. The structural light pole assembly of claim 12 further comprising an amplifier oriented within the frame internal cavity.

17. The structural light pole assembly of claim 12 further comprising a battery oriented within the frame internal cavity for providing a power source to the structural light pole.

18. A support base for supporting a structural pole upon and spaced above an underlying support surface, the support base comprising:

a footing region adapted to secure the support base to an underlying support surface;

a frame extending from the footing region, the frame defining an internal cavity for housing hardware that is associated with the structural pole assembly, the frame having an acoustical outlet region for permitting acoustical vibrations to pass therethrough;

a platform secured atop the frame, spaced apart from and opposing the footing region, the platform being adapted to secure the structural pole thereupon;

a first speaker assembly including:

a mid-plate oriented within the frame internal cavity and supported by the frame, the mid-plate being adjustable in height relative to the underlying support surface, the mid-plate being spaced apart from the platform, a speaker mounted to the mid-plate and oriented such that acoustical vibrations provided by the speaker are directed toward one of the underlying support surface and the base platform, and a resonating chamber member having a wall defining an elongated internal cavity oriented within the frame internal cavity, the resonating chamber member having an open end mounted adjacent to the speaker, and the resonating chamber member internal cavity being sized to match the speaker; and a structural pole having a fixed end mounted to the base platform such that the structural pole is spaced apart from the underlying support surface and supported by the base and the underlying support surface;

a second speaker assembly including:

a sub-plate affixed to the structural pole adjacent to an internal cavity formed in the fixed end of the structural pole, a speaker mounted to the sub-plate and oriented such that acoustical vibrations provided by the speaker are directed toward the base platform, and a resonating chamber member having a wall defining an elongated internal cavity oriented within the structural pole internal cavity, the resonating chamber member having an open end mounted adjacent to the speaker, and the resonating chamber member internal cavity being sized to match the speaker;

wherein the structural pole fixed end has an acoustical outlet region for permitting acoustical vibrations to pass therethrough.

19. The support base of claim 18 wherein the acoustical vibrations provided by the second speaker assembly have a lower frequency than the acoustical vibrations provided by the first speaker assembly.

20. The support base of claim 1 wherein each access opening has an area that is greater than a remaining surface area of the corresponding lateral side of the frame.

21. The support base of claim 1 wherein the frame further comprises a plurality of lateral sides and the at least two access openings further comprise a plurality of access openings, each formed through one of the lateral sides of the frame.

22. The support base of claim 1 wherein the support base is generally octagonal.

23. The support base of claim 1 further comprising a cover wherein one of the support base and the cover are generally round.

24. The support base of claim 1 wherein each access opening is generally tapered with an increasing width in a direction from the platform to the footing region.

25. The support base of claim 24 further comprising a cover defined by a series of ornamental panels, each being generally tapered with an increasing width in the direction from the platform to the footing region.

26. The support base of claim 8 wherein the support base and the cover are generally octagonal.

27. The structural light pole assembly of claim 12 wherein the structural light pole is further defined as a traffic light pole.

28. The structural light pole assembly of claim 12 further comprising at least two access openings formed through lateral sides of the frame for permitting access to the internal cavity.

29. The structural light pole assembly of claim 12 further comprising at least one plate oriented within the frame internal cavity and supported by the frame for receiving and supporting the hardware that is housed within the frame internal cavity at an orientation spaced above the underlying support surface.

30. The structural light pole assembly of claim 12 wherein the acoustical vibrations provided by the speaker are directed toward the underlying support surface.

* * * * *

UNITED STATES PATENT AND TRADEMARK OFFICE

CERTIFICATE OF CORRECTION

PATENT NO. : 7,219,873 B2
APPLICATION NO. : 10/874822
DATED : May 22, 2007
INVENTOR(S) : Ronald Paul Harwood It is certified that error appears in the above-identified patent and that said Letters Patent is hereby corrected as shown below:

Column 9, Line 59, Claim 12:

Delete “sneaker” and insert -- speaker --.

Signed and Sealed this

Twenty-first Day of August, 2007

JON W. DUDAS
*Director of the United States Patent and Trademark Office*